US008938900B1

(12) United States Patent
Halle

(10) Patent No.: US 8,938,900 B1
(45) Date of Patent: Jan. 27, 2015

(54) SIGN POST SYSTEM

(76) Inventor: John Halle, Ladera Ranch, CA (US)

( * ) Notice: Subject to any disclaimer, the term of this patent is extended or adjusted under 35 U.S.C. 154(b) by 114 days.

(21) Appl. No.: 13/607,215

(22) Filed: Sep. 7, 2012

Related U.S. Application Data

(60) Provisional application No. 61/532,339, filed on Sep. 8, 2011.

(51) Int. Cl.
*G09F 15/00* (2006.01)
*A45F 3/44* (2006.01)

(52) U.S. Cl.
USPC ..... 40/607.06; 40/607.09; 248/508; 248/545; 248/530

(58) Field of Classification Search
USPC ..... 40/607.05, 607.06, 607.08, 610, 40/611.01, 611.05, 611.06, 611.07, 40/611.09; 248/545, 218.4, 507, 508, 530, 248/156; 52/165; 173/90, 130
See application file for complete search history.

(56) References Cited

U.S. PATENT DOCUMENTS

| | | | | |
|---|---|---|---|---|
| 2,067,890 | A * | 1/1937 | Collord | 405/244 |
| 2,086,213 | A * | 7/1937 | Collord | 405/244 |
| 2,282,049 | A * | 5/1942 | Haggart, Jr. | 405/244 |
| 3,519,234 | A * | 7/1970 | Matson | 248/156 |
| 4,378,650 | A * | 4/1983 | Ottoson | 40/607.08 |
| 4,408,407 | A * | 10/1983 | Bloom et al. | 40/611.05 |
| 6,702,037 | B1 * | 3/2004 | Thiessen | 173/89 |
| 7,089,692 | B2 * | 8/2006 | Strait | 37/232 |
| 2004/0031178 | A1 * | 2/2004 | Kim | 40/607.05 |

* cited by examiner

*Primary Examiner* — Casandra Davis
(74) *Attorney, Agent, or Firm* — Larry K. Roberts

(57) ABSTRACT

A sign post system includes an elongated slide spike, and an impact anvil mounted to the slide spike at a location intermediate the spike ends. An elongated slide hammer column assembly slides onto the slide spike to contact the impact anvil while using the slide spike as a guide to deliver a force to the slide spike to drive the slide spike into the ground. A hollow sign post structure is configured to slide over the slide spike and cover at least a portion of the slide spike above the impact anvil, the slide spike and sign post configured to support a sign structure after installation. In an exemplary embodiment, the system parts are fabricated of plastic materials.

23 Claims, 9 Drawing Sheets

SIGN POST INSTALLATION

SLIDE SPIKE ASSEMBLY
Lock Wheel
22B
Three Point
Slide Spike
22
22A
Impact Anvil
24

Bolt and
Install Lock
Wheel
22B
Install and
Bolt Impact
Anvil at
Desired Depth

SLIDE HAMMER ASSEMBLY
26A
26B
Slide Hammer Column 26
Install Hammer Head
28

Pour In 10 LBS Sand or Steel Shot Into 6 Triangular Reservoirs
26
28

30
Install Lock Selector Cap 30
28

QUICK POST ASSEMBLY

Install Slide Hammer

Slide Hammer Down Spike And Turn Lock Wheel

SIGN POST INSTALLATION

SIGN AND FRAME INSTALLATION

Cross Section of T-Slot Frame

Cross Section of Sign Frame

SECONDARY SIGN
INSTALLATION OPTION

SIGN POST SYSTEM

CROSS-REFERENCE TO RELATED APPLICATION

This application claims priority from provisional application No. 61/532,339, filed Sep. 8, 2011, entitled SIGN POST SYSTEM, the entire contents of which application is incorporated herein by this reference.

BACKGROUND

Signs are used in many applications and industries, for example, the real estate sales industry. For example, many signs used in the real-estate sales industry are small, short signs that the realtor can push into the ground with a foot, but this is not always preferred. Most realtors prefer a large, tall sign to better market their listing. However, fitting a large sign into a realtor's vehicle may be impractical. In the past, a 7 foot tall sign installation would involve a shovel or post hole digger which can become very labor intensive, and messy for a professional wearing a suit. Many conventional wood signs weigh up to 50 pounds, making it cumbersome and difficult to install without a truck and necessary tools.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1A:
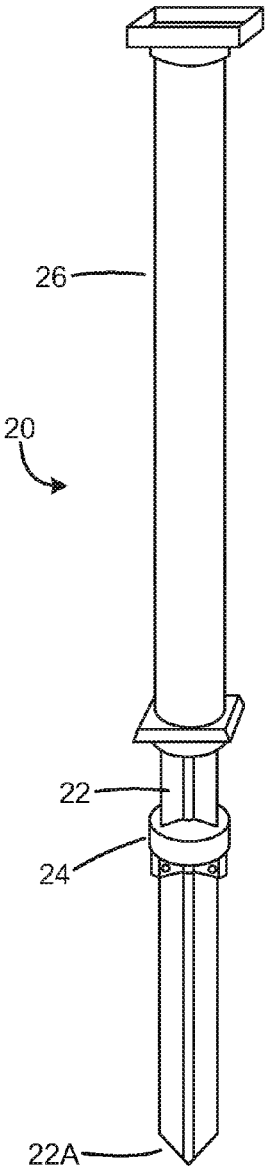
FIG. 1A is an isometric view of an exemplary embodiment of a slide hammer column assembly for a sign post system.

In the following detailed description and in the several figures of the drawing, like elements are identified with like reference numerals. The figures are not to scale, and relative feature sizes may be exaggerated for illustrative purposes.

An exemplary embodiment of the sign post system is an all vinyl, recyclable sign used in any business or personal setting where a large sign is needed in an outdoor application and fast installation and removal is preferred. In one form, the sign system is a 3 to 7 foot tall sign that a man or woman can install in a short time, e.g. five minutes.

One feature of an exemplary embodiment of a sign post system is a quick post installation system, in which a slide hammer, of weight which may be selected by the user, is used to install and remove a stake or spike. For example, as long as the person can lift 8-13 pounds (the weight of the slide hammer) up and down 10 to 20 times, the person can install one exemplary embodiment of a sign post system as described in this application.

Another feature is the design of the "quick post" system, in that it is designed to be concealed inside the sign post. This "quick post" system provides the following solution. The slide hammer and stake or spike serve two functions. The stake or spike is used as a guide for the slide hammer and the same stake or spike is used to hold the vinyl sign post. This eliminates the need to bring installation tools which can dirty a sales person's vehicle.

Another feature is the "signature sign" shape, i.e. a unique vinyl sign shape for defining a company's identity and affording their company the opportunity to stand out and not blend in with their competition. Also, these vinyl signs may be bent into shapes. For instance a company called "Secure Realty" might have a shield shape or badge shape used in their marketing. This sign would stand out from the rest because a shape can be recognized from as far as 1000 feet whereas the typical realtor sign must be read from no more than 100 feet away. This helps companies increase their marketing exposure. Also these signature signs are designed to break down small enough to transport in a small car or truck.

By using vinyl to fabricate components of the sign post system, e.g. such as vinyl similar to that used in the vinyl window and fencing industry, a superior product can be provided that will last years, e.g. 25 years, and can be recycled. At least some of the sign post components can be fabricated of recycled plastic from old vinyl windows and trim.

FIG. 1A is an isometric view of an exemplary embodiment of a slide hammer column assembly 20, i.e. the "quick post" assembly, for a sign post system. The assembly 20 includes an elongated slide spike 22, formed in this example as a three-bladed or multi-vaned spike with a tapered point end 22A, an impact anvil 24 mounted to the slide spike, and a slide hammer column 26, fitted onto the slide spike.

Figure 1B:
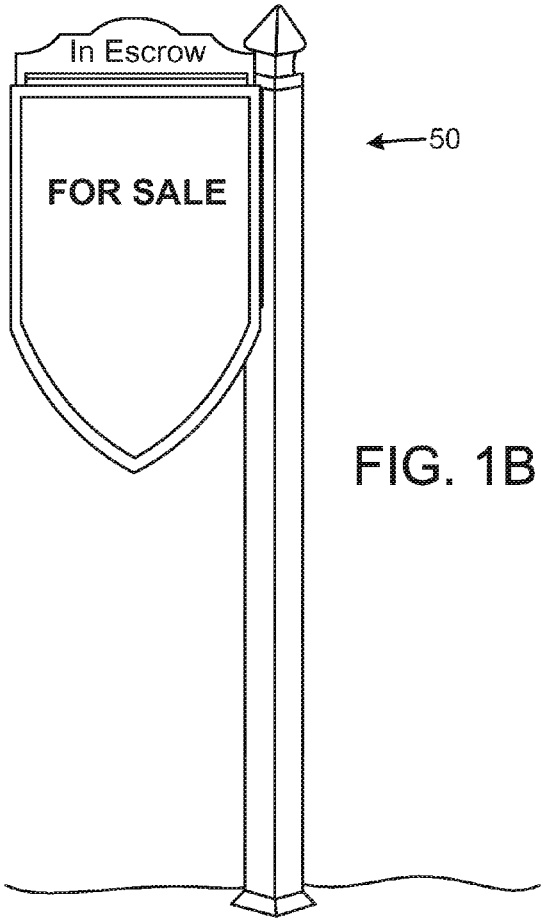
FIG. 1B is an isometric view of an exemplary embodiment of an installation of a sign post system

FIG. 1B is an isometric view of an exemplary embodiment of an installation of a sign post system 50.

Figures 1, 2:
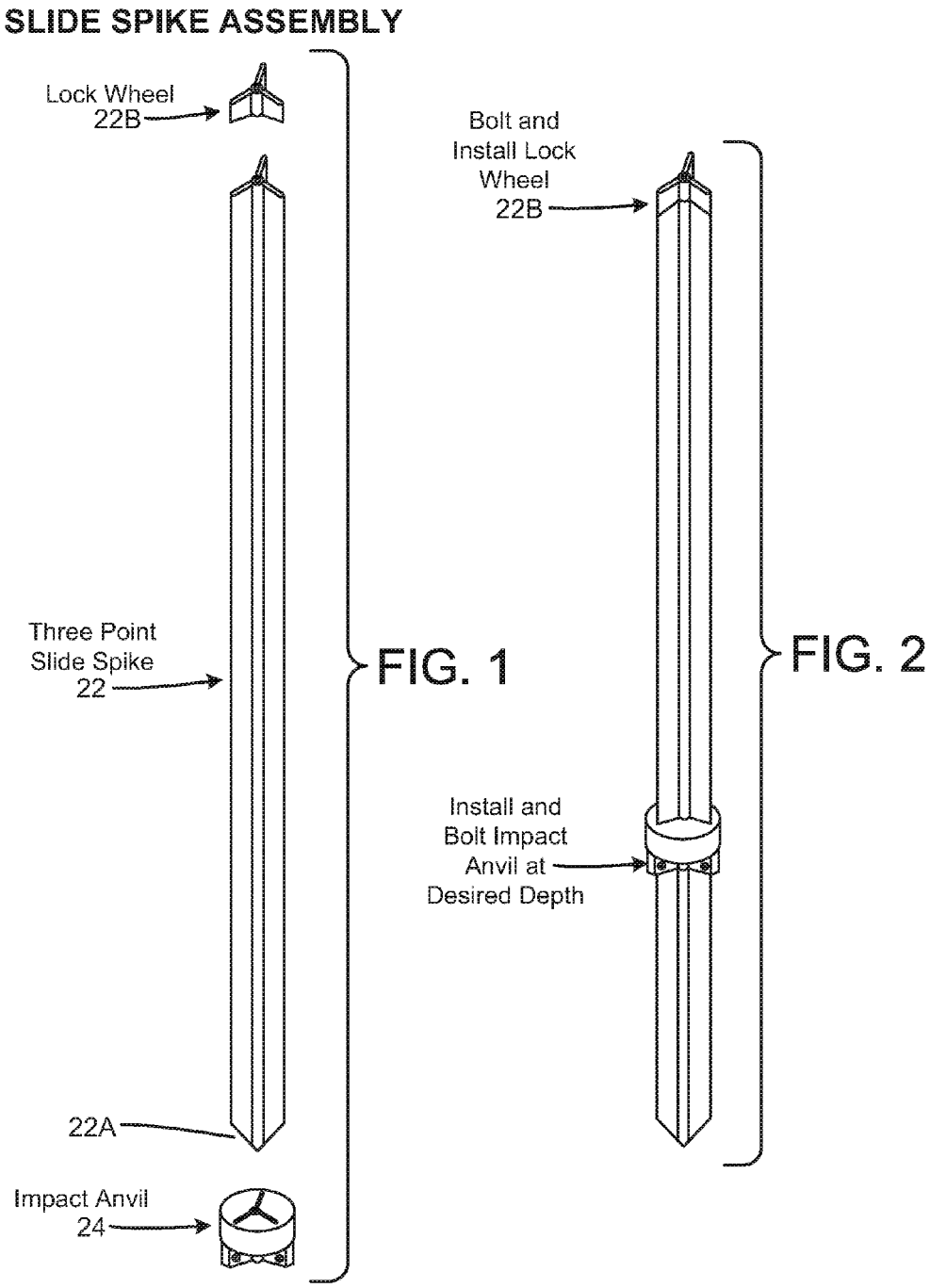
FIG. 1 is an exploded isometric view of a lock wheel, a three point slide spike and an impact anvil for a sign post system.
FIG. 2 is an isometric view similar to FIG. 1, but with the impact anvil and lock wheel assembled to the slide spike.

FIG. 1 is an exploded isometric view illustrating a lock wheel 22B to be attached to the upper end of the slide spike 22, the three point slide spike 22 and the impact anvil 24.

FIG. 2 is an isometric view similar to FIG. 1, but with the impact anvil 24 and lock wheel 22B assembled to the slide spike 22. The spike and the anvil are each preferably fabricated of a plastic material, such as a vinyl such as PVC, although another material suitable for the anvil is a polycarbonate. For some applications, the anvil and the hammer head 28 may be made of a metal The anvil has an interior opening configuration which matches the exterior cross-section shape of the slide spike, with sufficient clearance to allow the impact anvil to be slid up and down the slide spike. This can allow the anvil to be positioned at a range of height positions above the spike tip end 22A, to adjust the depth of the spike to be driven into the ground. The anvil may be fastened to the spike by large diameter bolts extending through openings formed in the three blades or vanes of the spike and secured by threaded fasteners, or by rivets if the anvil is to be pre-positioned at a fixed position. The lock wheel can be assembled to the top end of the spike by a long bolt extending into a bore formed in the center of the spike end, e.g. a long thin wood screw or a machine screw fitted into a drilled and tapped hole in the center of the spike. The lock wheel is attached in such a way as to be rotatable about the spike center axis.

In one embodiment, the spike 22 is an extruded component, cut to length, and the lock wheel may be a short piece cut from an extrusion from the same mold used to fabricate the spike. In another embodiment, the lock wheel may be fabricated of a more durable metal material.

Figures 3, 4, 5:
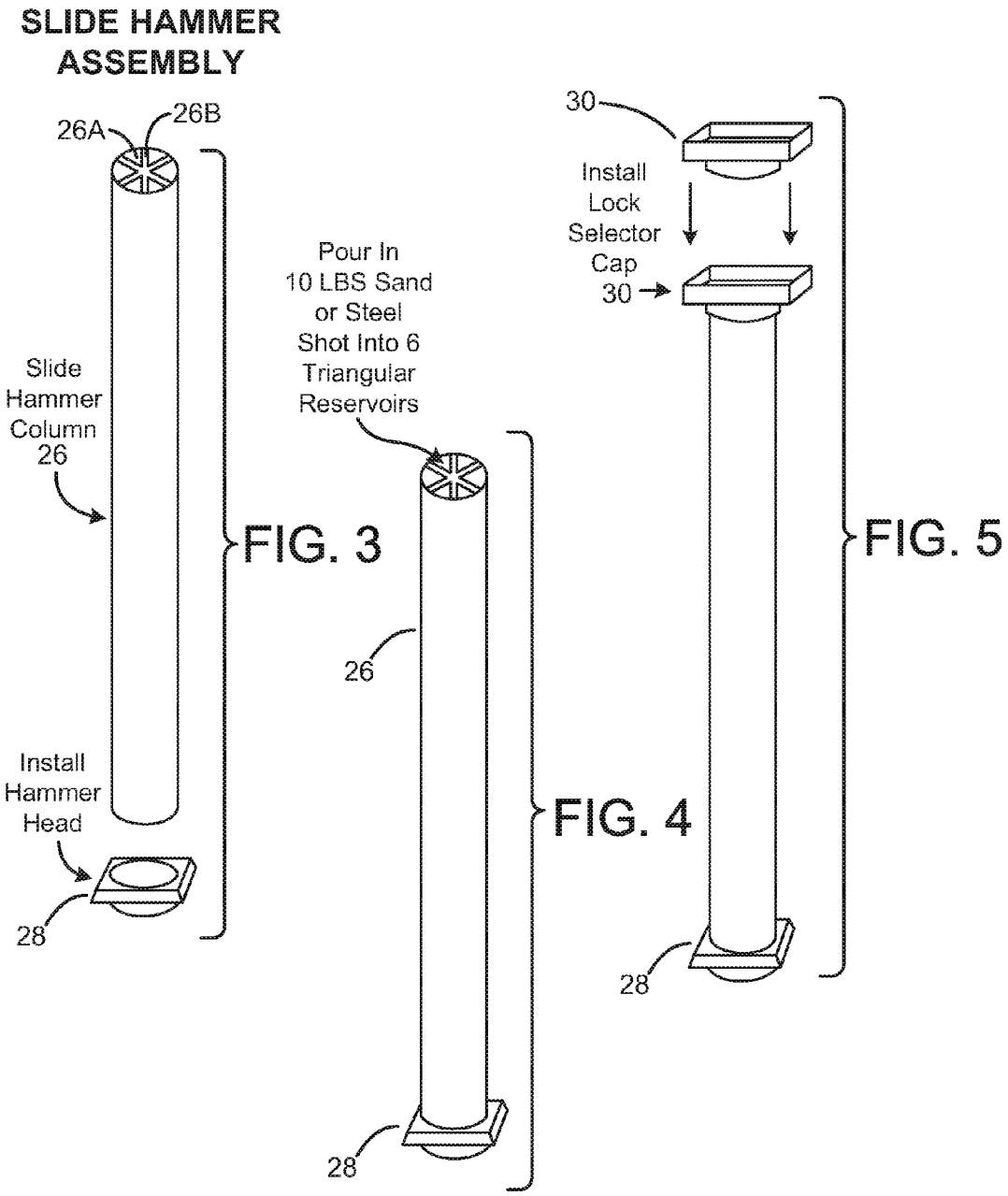
FIG. 3 is an exploded isometric view illustrating a slide hammer column and hammer head for a sign post system.
FIG. 4 is an isometric view similar to FIG. 3, but with the hammer head installed on the slide hammer column.
FIG. 5 is an isometric view of the slide hammer column as in FIG. 4, with a lock selector cap shown in an exploded position and as installed on the slide hammer column.

FIG. 3 is an exploded isometric view illustrating an exemplary slide hammer column 26 and hammer head 28 for the sign post system. FIG. 4 is an isometric view similar to FIG. 3, but with the hammer head 28 installed on the slide hammer column 26, e.g. by adhesive or threaded fasteners. The column and hammer head are each preferably fabricated of a plastic material such as PVC, or at least in the case of the hammer head, a polycarbonate. The column can be extruded to form an interior configuration as shown in FIGS. 3 and 4, with radial double walls defining radial pathways or openings and triangular reservoirs. The radial pathways include a first set designed to conform to the exterior configuration of the slide spike, so that the column can be slide onto the slide spike from the top end thereof. The radial pathways includes a second set of pathways or openings interleaved between the first set, in this exemplary embodiment. In other embodiments, the second set may be omitted. The triangular reservoirs are designed to receipt ballast such as sand or steel shot, to give weight to the slide hammer. The hammer head 28 has an interior opening configuration which conforms to the exterior configuration of the slide spike, so that the top end of the spike can enter the column through the hammer head as the column is slid onto the spike, but which closes the bottom openings of the reservoir to prevent escape of the ballast material from the bottom of the column assembly. For example, 10 pounds of sand or steel shot or other ballast material may be poured into the open top of the triangular reservoirs as indicated in FIG. 4.

FIG. 5 is an isometric view of the slide hammer column as in FIG. 4, with a lock selector cap 30 shown in an exploded position and as installed on the slide hammer column. The lock selector cap 30 may be installed onto the top of the column, e.g. by adhesive, after the ballast material is in place. The cap 30 has an interior opening configuration including a first set of radial openings which conforms to the cross-sectional configuration of the slide spike, so that the hammer column may be slid up and down the spike in a hammering movement. The cap 30 includes a second set of radial openings matching the second set of radial openings in the column, and the cap 30 is attached to the column so that the respective first and second sets of radial openings are aligned.

Figures 6A, 6B, 6C:
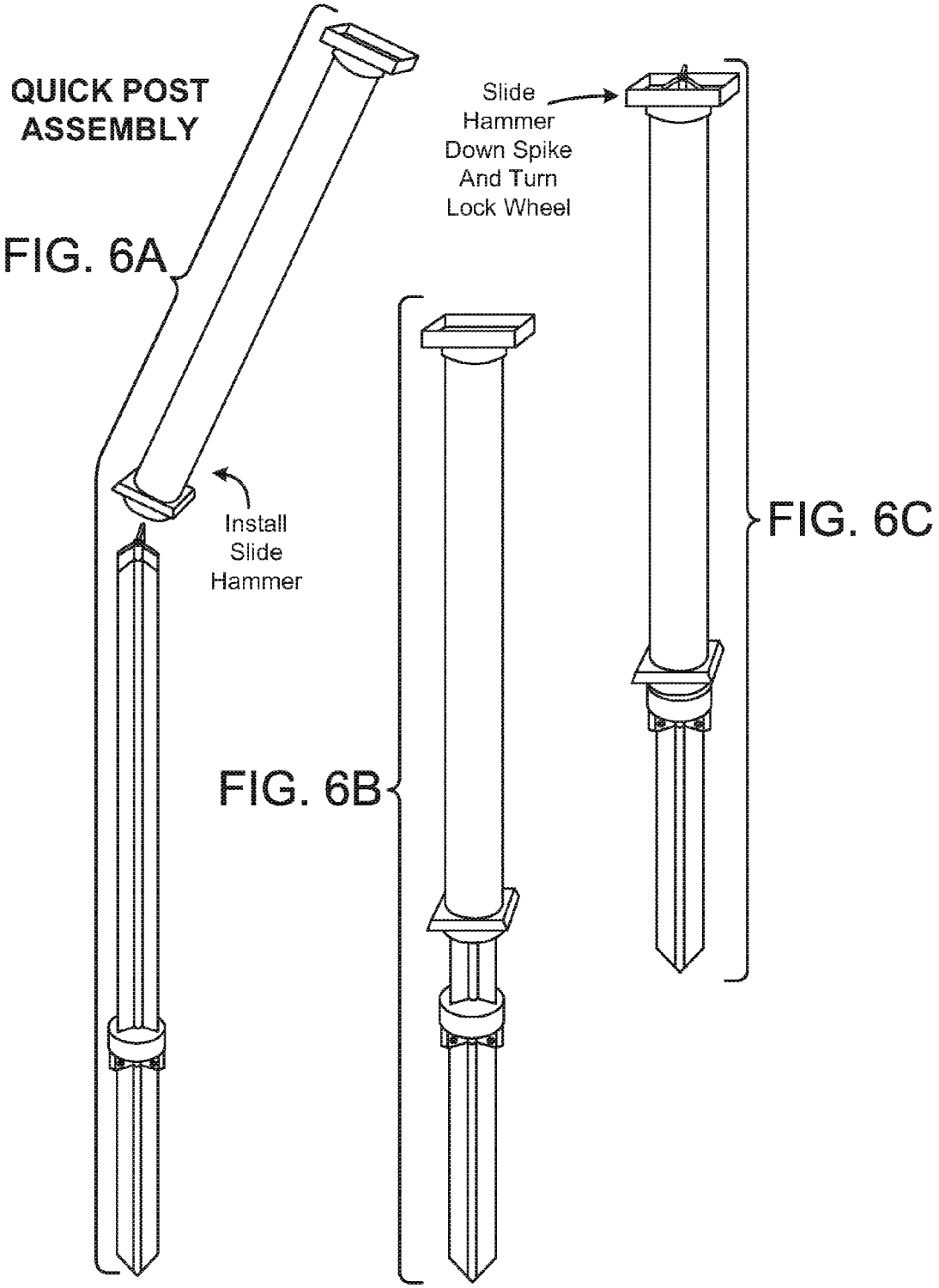
FIG. 6A is an isometric view of the assembled slide hammer column about to be installed onto the slide spike.
FIG. 6B is an isometric view of the slide hammer column on the slide spike for sliding movement to address the impact anvil.
FIG. 6C is an isometric view of the slide hammer column in a lowermost position, with the hammer head resting against the impact anvil.

FIG. 6A is an isometric view of the assembled slide hammer column 30 about to be installed onto the slide spike 22. In one embodiment, the slide hammer column has a length about the same length or slightly shorter than the length of the spike above the anvil, to reduce risk of the user's hand coming into contact with the top of the spike and lock wheel at the bottom of a hammer stroke. The hammer column length is selected such that the lock wheel is exposed from the lock selector cap after being installed onto the slide spike and with the bottom portion of the hammer column in contact with the anvil. In other embodiments, the column 30 may be shorter than the length of the spike above the anvil.

FIG. 6B is an isometric view of the slide hammer column on the slide spike for sliding movement to address the impact anvil in a hammering movement. FIG. 6C is an isometric view of the slide hammer column in a lowermost position, with the hammer head resting against the impact anvil.

Figure 6D:
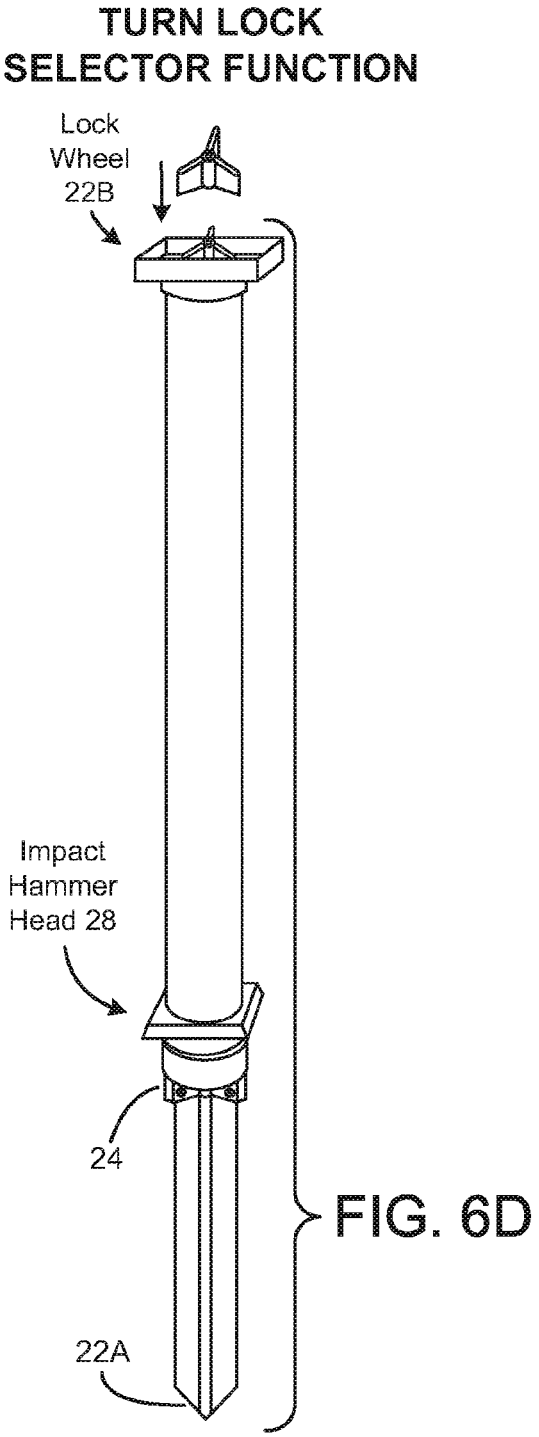
FIG. 6D is similar to FIG. 6C, but with the lock wheel in both an exploded position and installed position on the slide spike.

In one embodiment, the slide hammer can be removed from the slide spike after the slide spike has been hammered into the ground to a desired depth. This embodiment permits one slide hammer to be used for multiple sign posts. However, in another embodiment, the slide hammer can be stored within the sign post. FIG. 6D is similar to FIG. 6C, but with the lock wheel 22B in both an exploded position and installed position on the slide spike.

Figure 7:
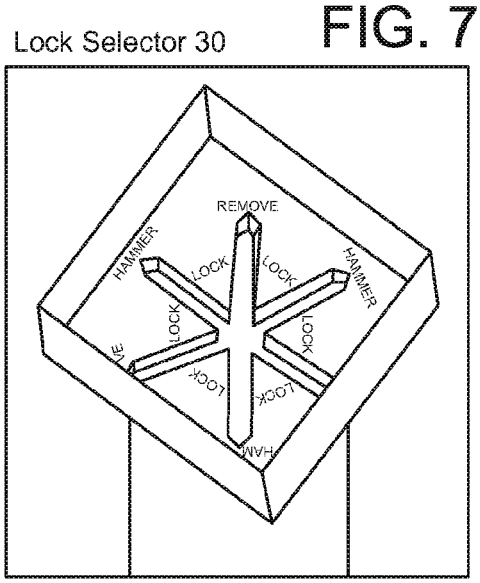
FIG. 7 is a top isometric view showing the turn lock selector.

FIG. 7 is a top isometric view showing the turn lock selector cap 30. The cap has six radial openings, twic the number of vanes on the slide spike, and the lock wheel on the spike can be turned to line up with different function positions. With the wheel aligned with the lock positions, i.e. with the vanes of the lock wheel not aligned with the radial openings but overlaying solid structure of the turn lock selector, the hammer cannot be removed from the slide, and by pulling on the hammer column with the wheel in the lock position, the post can be pulled from the soil under typical conditions in which the soil is loose or relatively soft. By aligning the wheel in the hammer position, the hammer can be lifted and dropped to pound in the spike, or lifted completely off the spike. By aligning the wheel in the remove (the post system) or hammer-up position, the hammer column can be lifted up until the top surface of the impact hammer head 28 impacts the lock wheel 22B, providing a hammer-up function to remove the spike from hard soils.

Figure 8:
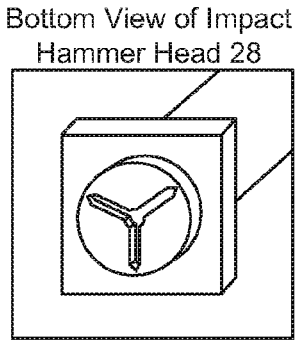
FIG. 8 is a bottom isometric view illustrating in further detail the hammer head.

FIG. 8 is a bottom isometric view illustrating in further detail the hammer head 28.

Figure 9:
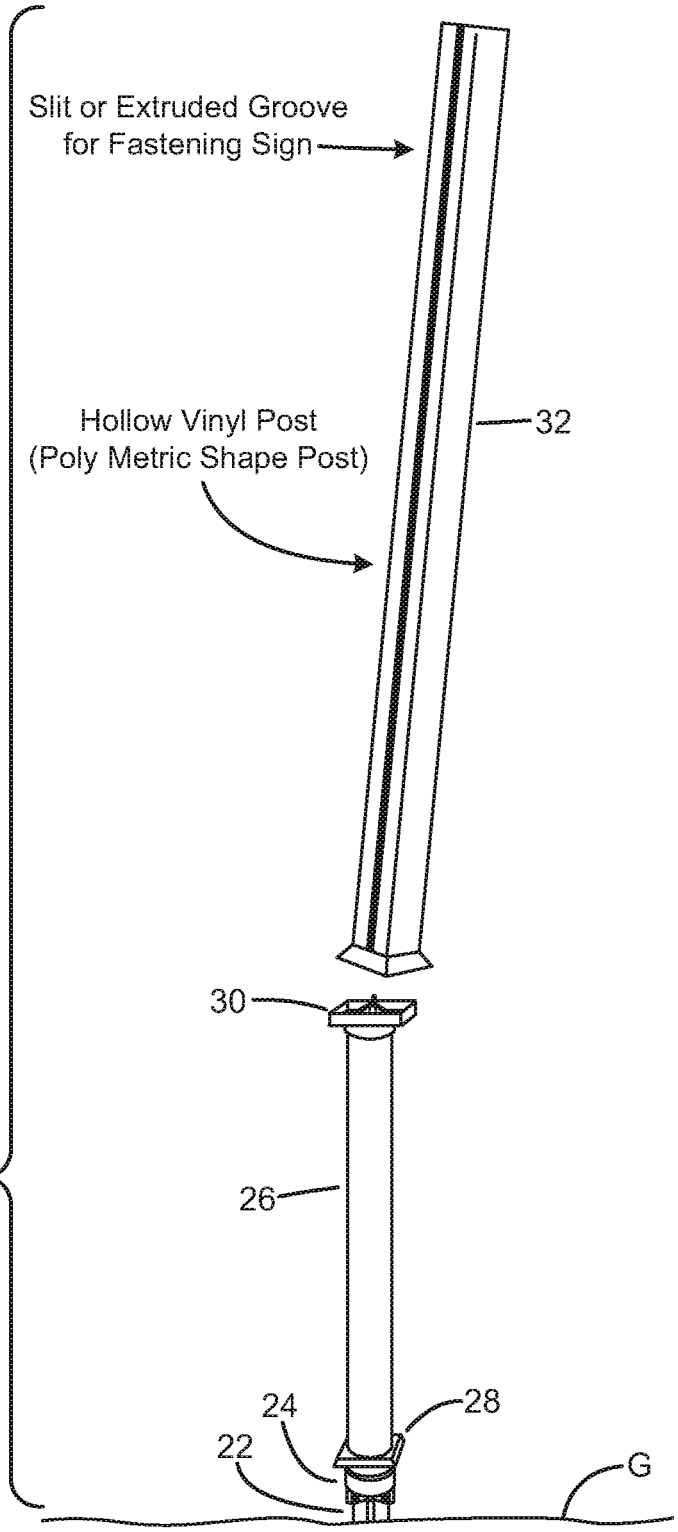
FIG. 9 is an exploded isometric view illustrating a hollow post in position for sliding over the turn lock selector and the slide hammer column.

FIG. 9 is an exploded isometric view illustrating a hollow post 32 in position for sliding over the turn lock selector 30 and the slide hammer column 26 in assembled condition on a slide spike 22 which has been hammered into the ground G. The hollow post 32 is fabricated of a plastic material or vinyl such as PVC. The post has an interior hollow opening configured to fit over the turn lock selector and the hammer column. Alternatively the slide hammer column may be removed prior to assembly of the hollow post, so that the post fits over the slide spike, and its base fits onto the anvil. The post is constrained from rotation about the slide spike by interference with the blades of the spike, or interference with the hammer column if installed, or engagement with the anvil.

Figure 10:
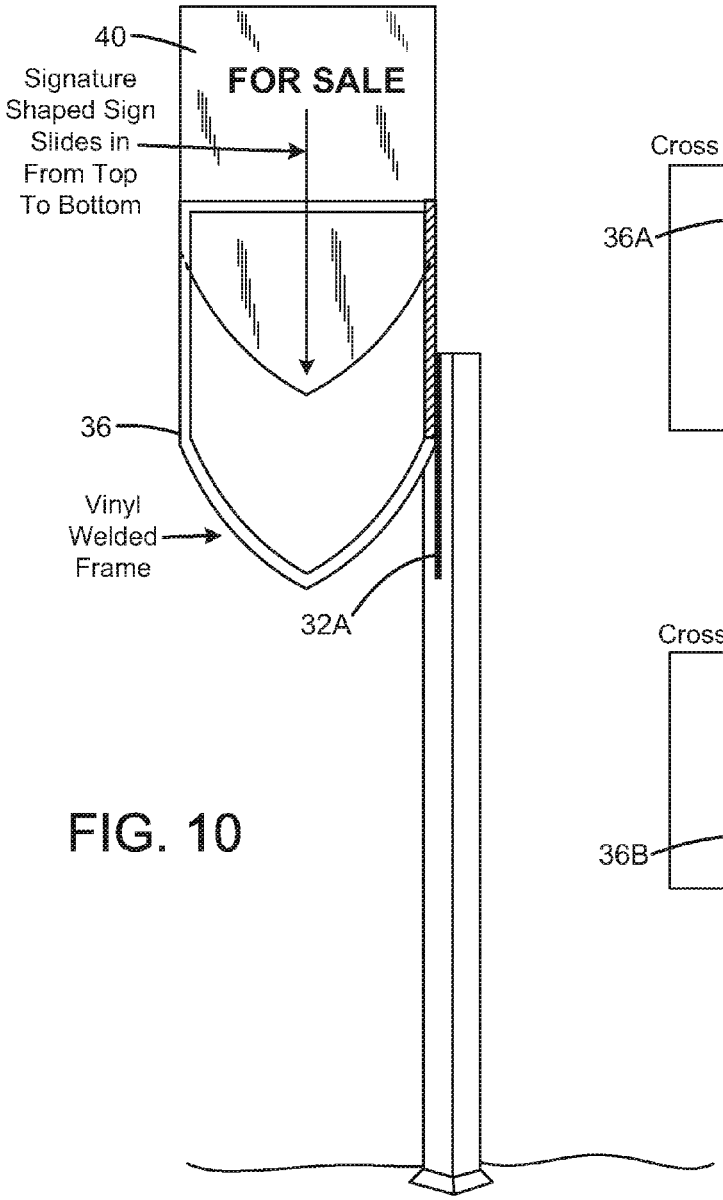
FIG. 10 shows the hollow post in assembled position, to receive a sign frame.
Figure 11:
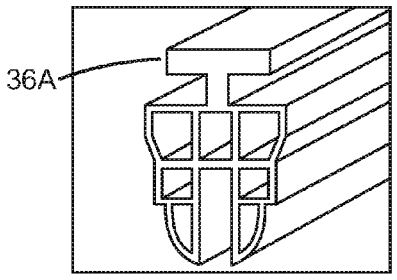
FIGS. 11 and 12 are diagrammatic cross-section views showing details of exemplary embodiment of the sign frame.
Figure 12:
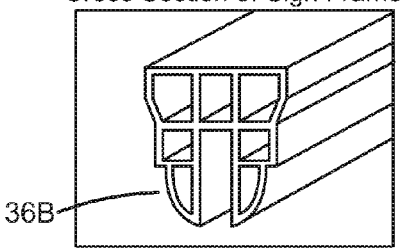
Figure 13:
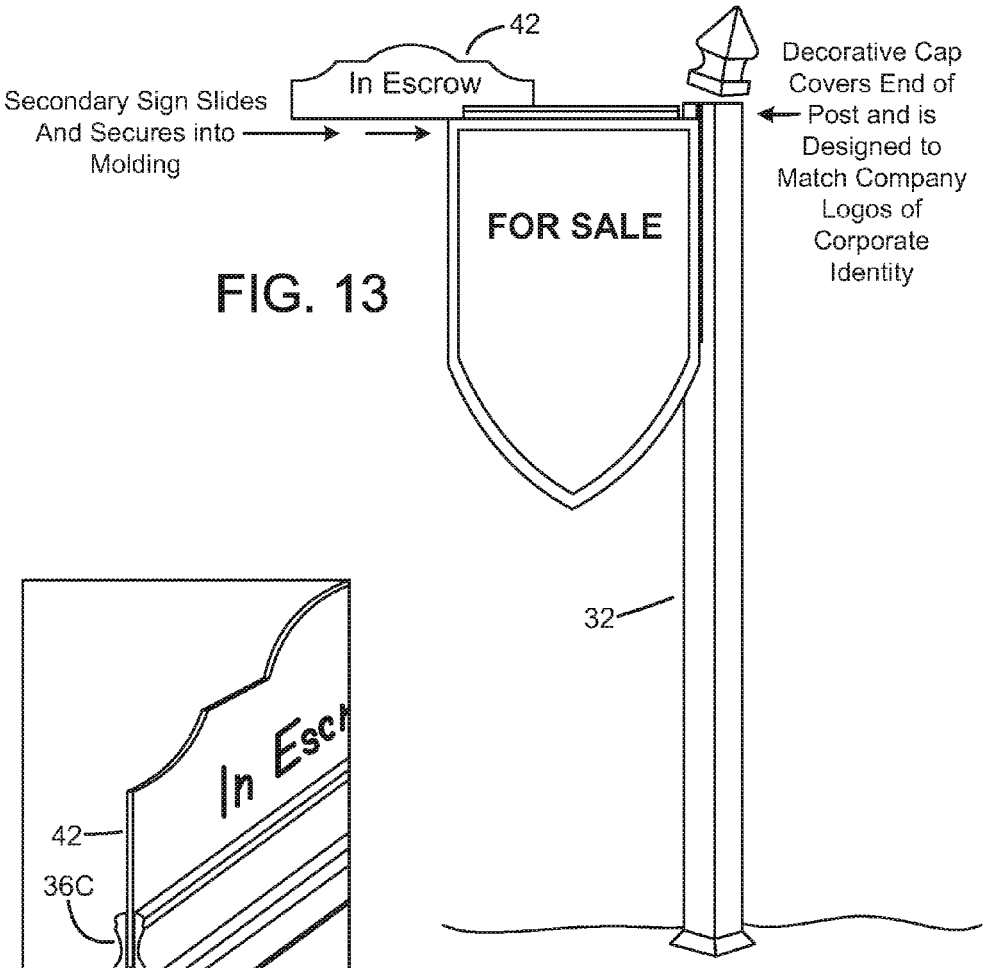
FIG. 13 is a diagrammatic isometric view of an installed post system, with a secondary sign to slide into a molding of the sign frame.
Figure 13A:
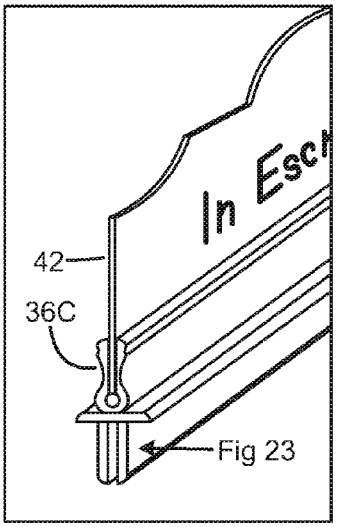
FIG. 13A is a detail view illustrating an exemplary embodiment of the molding and secondary sign.
Figure 14A:
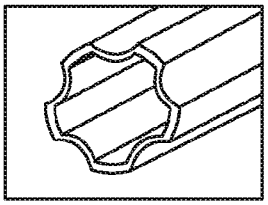
FIGS. 14A-14D illustrate four alternate exemplary shapes and profiles of a hollow sign post for the system.
Figure 14B:
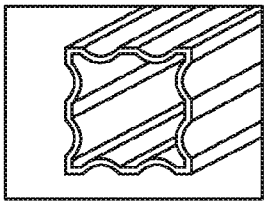
Figure 14C:
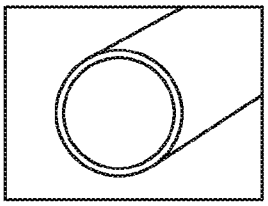
Figure 14D:
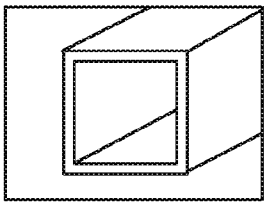

FIG. 10 shows the hollow post 32 in assembled position, to receive a sign frame 36 in a slot 32A. The sign frame 36 may include a T-slot member 36A as shown in FIG. 11 to engage the slot 32A in the post. A sign 40 may be slid into the frame 36 from the top and be captured inside a slot 36B (FIG. 12). An optional secondary sign 42 may be supported by engagement with a slot feature 36C in the top of the frame 36, as illustrated in FIGS. 13 and 13A.

The hollow post 32 can have various cross sectional configurations, and can be fabricated from an extrusion. FIGS. 14A-15D illustrate alternative cross-sectional configurations of a hollow post.

How to install and remove the sign post or "quick post":

Remove the light weight slide hammer and slide spike assembly from the user's vehicle, and bring to desired location. The slide spike will penetrate most soils and grasses. Now, with the lock wheel at the hammer position, lift the slide hammer, typically weighing between 8-13 pounds, on the slide spike and drop the hammer. For typical soils, each lift and drop action will sink the post around one inch at a time, therefore installing the post in 10-20 lift and drops. Once the "quick post" is imbedded in the soil, the user can slide the hollow vinyl sign post over the "quick post" i.e. the slide spike and slide hammer assembly. This embodiment of the slide hammer or "quick post" is designed to be concealed inside the sign post.

Two unique solutions before installing the hollow sign post over the "quick post."

The slide hammer may be made to be removed or left inside the sign post. If the user unlocks the hammer (by aligning the lock wheel 22B with the "lock" positions on the lock selector 30 as described above) and slides it up and off the slide stake, only the stake is left in the ground. The slide stake can be any suitable length, but an exemplary length is on the order of three feet. Now the user can slide the sign post over the stake and install the sign. The hollow sign post in this case would have an interior shape configuration to receive the stake to keep the sign straight and prevent the post from spinning in the wind. The benefit of this concept is to eliminate the need for a slide hammer on every "quick post", making it cost effective. For instance, a professional sign installation company can buy two hammers and 20 signs, saving them money.

If a customer does not want to take the slide hammer off because of convenience, the hollow sign posts may be designed to slide over both the slide hammer and the slide stake. The sign post will simply slide over the entire "quick post" and slide hammer assembly. This will simplify the installation process. With the post set up, the user can simply install the desired signature sign on to the post and the sign is finished.

Removing the "Quick Post:"

Removing the sign is a simple procedure. Instead of hammering downward, select the "remove" position on the lock wheel of the slide spike, and simply hammer upward to remove the slide spike out of the soil. Alternatively, for loose soils, the lock wheel can be set to the "lock" position, and by gripping the outside of the hammer column, the entire sign post assembly can be pulled from the soil.

Although the foregoing has been a description and illustration of specific embodiments of the invention, various modifications and changes thereto can be made by persons skilled in the art without departing from the scope and spirit of the invention.

What is claimed is:

1. A sign post system, comprising:

an elongated slide spike having a first end configured to enter the ground for installation, and a second end configured to be disposed above ground after installation;

an impact anvil mounted to the slide spike at a location intermediate the first and second ends;

an elongated slide hammer column assembly configured to slide onto the slide spike at the second end, and configured to slide over the slide spike to contact the impact anvil while using the slide spike as a guide to deliver a force to the slide spike to drive the slide spike first end into the ground, the slide hammer column assembly configured for manual use by a user to lower and raise the slide hammer column assembly repeatedly to drive the slide spike into the ground to a desired depth for installation;

a hollow sign post structure configured to slide over the second end of the slide spike and cover at least a portion of the slide spike above the impact anvil, the slide spike and sign post configured to support a sign structure after installation; and wherein the hammer column assembly is further configured with the hollow sign post structure such that the hollow sign post structure covers the hammer column assembly as well as the portion of the slide spike after installation.

2. The system of claim 1, wherein the slide spike, the impact anvil, the hammer column assembly and the sign post structure are each fabricated of a plastic material.

3. The system of claim 1, wherein the slide spike is a multi-vaned structure.

4. The system of claim 1, further comprising the sign structure, and wherein the sign structure includes a feature configured to removably attach to the sign post so that the sign structure is attachable to the sign post after installation and a visible sign message carried by the sign structure is oriented in a generally transverse position relative to the sign post.

5. The system of claim 1, wherein the sign post includes a slot defined at an upper end thereof, and the feature of the sign structure includes a T-slot member arranged to engage the slot.

6. The system of claim 1, wherein the slide hammer column assembly defines a ballast reservoir system inside an outer wall, the reservoir system configured to hold a quantity of ballast material to increase the weight of the assembly.

7. The system of claim 6, further comprising a quantity of ballast material.

8. The system of claim 1, wherein the elongated slide hammer column assembly includes a cylindrical outer wall.

9. The system of claim 8, wherein the hollow sign post structure includes an outer wall having a cylindrical configuration.

10. The system of claim 8, wherein the hollow sign post structure includes an outer wall having a non-cylindrical configuration.

11. The syctcm of Claim 1, A sign post system, comprising:

an elongated slide spike having a first end configured to enter the ground for installation, and a second end configured to be disposed above ground after installation, wherein the slide spike is a multi-vaned structure;

an impact anvil mounted to the slide spike at a location intermediate the first and second ends;

an elongated slide hammer column assembly configured to slide onto the slide spike at the second end, and configured to slide over the slide spike to contact the impact anvil while using the slide spike as a guide to deliver a force to the slide spike to drive the slide spike first end into the ground, the slide hammer column assembly configured for manual use by a user to lower and raise the slide hammer column assembly repeatedly to drive the slide spike into the ground to a desired depth for installation;

a hollow sign post structure configured to slide over the second end of the slide spike and cover at least a portion of the slide spike above the impact anvil, the slide spike and sign post configured to support a sign structure after installation; and wherein said impact anvil has an interior opening configuration which matches an exterior cross-section configuration of the slide spike, with sufficient clearance to allow the impact anvil to be slid up and down the slide spike prior to assembly of the impact anvil to the slide spike.

12. The system of claim 11, wherein the anvil is configured to be positioned at a range of height positions above the slide spike first end to adjust the depth of the spike to be driven into the ground, and wherein the impact anvil is configured for attachment to the slide spike by fasteners extending through openings formed in vanes of the slide spike.

13. A sign post system, comprising:

an elongated slide spike having a first end configured to enter the ground for installation, and a second end configured to be disposed above ground after installation;

an impact anvil mounted to the slide spike at a location intermediate the first and second ends;

an elongated slide hammer column assembly configured to slide onto the slide spike at the second end, and configured to slide over the slide spike to contact the impact anvil while using the slide spike as a guide to deliver a force to the slide spike to drive the slide spike first end into the ground, the slide hammer column assembly configured for manual use by a user to lower and raise the slide hammer column assembly repeatedly to drive the slide spike into the ground to a desired depth for installation;

a hollow sign post structure configured to slide over the second end of the slide spike and cover at least a portion of the slide spike above the impact anvil, the slide spike and sign post configured to support a sign structure after installation;

wherein the slide hammer column assembly defines a ballast reservoir system inside an outer wall, the reservoir system configured to hold a quantity of ballast material to increase the weight of the assembly; and wherein the slide hammer column assembly includes a hammer head attached to the exterior wall at an impact end of the assembly, the assembly and head having an interior opening configuration which matches an exterior cross-sectional configuration of the slide spike, with sufficient clearance to allow the assembly to be slid up and down on the slide spike, and the hammer head cross-sectional configuration configured to close the ballast reservoir at the impact end of the assembly.

14. The system of claim 13, wherein the slide hammer column assembly further includes a cap structure fitted to an upper end of assembly opposite the impact end, the cap structure having an interior opening configuration including a set of radial openings which matches the exterior cross-sectional configuration of the slide spike, with sufficient clearance to allow the assembly to be slid up and down on the slide spike, said cap structure further configured to close the ballast reservoir at said upper end.

15. A sign post system, comprising:

an elongated slide spike having a first end configured to enter the ground for installation, and a second end configured to be disposed above ground after installation;

an impact anvil mounted to the slide spike at a location intermediate the first and second ends;

an elongated slide hammer column assembly configured to slide onto the slide spike at the second end, and configured to slide over the slide spike to contact the impact anvil while using the slide spike as a guide to deliver a force to the slide spike to drive the slide spike first end into the ground, the slide hammer column assembly configured for manual use by a user to lower and raise the slide hammer column assembly repeatedly to drive the slide spike into the ground to a desired depth for installation;

a hollow sign post structure configured to slide over the second end of the slide spike and cover at least a portion of the slide spike above the impact anvil, the slide spike and sign post configured to support a sign structure after installation;

a rotatable lock structure attached at said second end of the slide spike, and arranged to be rotatable through a range of motion at least between a lock position and a hammer position; and a cap structure fitted to an upper end of the slide hammer column assembly opposite an impact end, the cap structure having an interior opening configuration including a set of radial openings which matches the exterior cross-sectional configuration of the slide spike, with sufficient clearance to allow the assembly to be slid up and down on the slide spike, said cap structure further configured to block removal of the slide hammer column assembly from the slide spike by interference with the lock structure in the lock position, and allow up and down hammer motion and removal of the slide hammer column assembly relative to the slide spike with the lock structure in the hammer position.

16. The system of claim 15, wherein the slide spike is a one-piece multi-vaned structure with a center rod-like structure and a plurality of radial vane portions, the lock structure has a cross-sectional configuration with a center structure and vane portions matching that of the slide spike, and the cap structure interior opening configuration permitting the lock structure and slide spike to pass through with the lock structure vane portions aligned with vane portions of the slide spike in the hammer position, and the lock structure vane portions blocked by the cap structure with the lock structure rotated to the lock position.

17. A sign post system, comprising: an elongated slide spike having a first end configured to enter the ground for installation, and a second end configured to be disposed above ground after installation, the slide spike having [N] a plurality of radial vanes extending from a center portion;

an impact anvil mounted to the slide spike at a location intermediate the first and second spike ends, wherein a lower spike portion extends below the impact anvil to the first spike end and an upper spike portion extends above the impact anvil to the second spike end;

an elongated slide hammer column assembly configured to slide onto the slide spike at the second end, and configured to slide over the slide spike to contact the impact anvil while using the slide spike as a guide to deliver a force to the slide spike to drive the slide spike first end into the ground, the slide hammer column assembly configured for manual use by a user to lower and raise the slide hammer column assembly repeatedly to drive the slide spike into the ground to a desired depth for installation, the assembly including an outer cylindrical wall structure including a first set of radial openings and an interior structure defining an opening configuration extending an entire length of the wall structure and configured to generally match an external cross-sectional configuration of the slide spike with sufficient clearance to allow the assembly to slide up and down on the slide spike, a hammer head attached to a first end of the assembly and a cap structure attached to a second end of the assembly, the interior structure, the hammer head, the cap structure and the outer cylindrical wall structure defining an interior ballast reservoir system;

a hollow sign post structure configured to slide over the second end of the slide spike and cover at least a portion of the slide spike above the impact anvil, the slide spike and sign post configured to support a sign structure after installation.

18. The system of claim 17, wherein the hollow sign post structure has an external cylindrical wall.

19. The system of claim 17, wherein the hollow sign post structure has an external non-cylindrical wall.

20. The system of claim 19, wherein the external non-cylindrical wall has a rectilinear configuration.

21. The system of claim 17, wherein the slide spike, the impact anvil, the hammer column assembly and the sign post structure are each fabricated of a plastic material.

22. The system of claim 21, wherein the hammer head is fabricated of a plastic material.

23. The system of claim 17, further comprising:

a rotatable lock structure attached at said second end of the slide spike, and arranged to be rotatable through a range of motion including a lock position, a post system remove position and a hammer position, the lock structure including N vanes extending from a center portion and matching the cross-sectional configuration of the slide spike;

the opening configuration of the interior structure including a second set of radial openings extending the entire length of the wall structure interleaved between the radial openings of the first set;

the cap structure including a first set of radial openings and a second set of radial openings respectively aligned with the first and second sets of radial openings of the interior structure;

said cap structure further configured to block removal of the slide hammer column assembly from the slide spike by interference with the lock structure in the lock position, to allow up and down hammer motion and removal of the slide hammer column assembly relative to the slide spike with the lock structure in the hammer position and aligned with the first set of radial openings in the cap structure, and to allow up and down hammer motion with the hammer impacting the lock structure with the lock structure in the post system remove position and aligned with the second set of radial openings in the cap structure.

* * * * *